United States Patent [19]

Miura et al.

[11] Patent Number: 4,827,891

[45] Date of Patent: May 9, 1989

[54] IGNITION APPARATUS FOR PREVENTING UNNECESSARY CHARGING IN AN INTERNAL COMBUSTION ENGINE

[75] Inventors: Nobuo Miura; Hitoshi Nakayama; Nolihisa Ishii, all of Wako-City; Hidenori Maeda, Hanno, all of Japan

[73] Assignees: Honda Giken Kogyo Kabushiki Kaisha, Tokyo, Japan; Shindengen Kogyo Kabushiki Kaisha, Tokyo, Japan

[21] Appl. No.: 82,345

[22] Filed: Aug. 6, 1987

[30] Foreign Application Priority Data

Aug. 23, 1986 [JP] Japan ..... 61-128725[U]
Aug. 23, 1986 [JP] Japan ..... 61-128726[U]

[51] Int. Cl.[4] ..... F02P 3/09

[52] U.S. Cl. ..... 123/598; 123/630; 123/631

[58] Field of Search ..... 123/598, 631, 632, 630, 123/146.5 D; 290/41

[56] References Cited

U.S. PATENT DOCUMENTS

| | | | |
|---|---|---|---|
| 3,487,822 | 1/1970 | Hufton | 123/598 |
| 3,534,719 | 10/1970 | Minks | 123/598 |
| 3,597,651 | 8/1971 | Hufton | 123/631 |
| 3,599,616 | 8/1971 | Oishi | 123/598 |
| 3,605,714 | 9/1971 | Hardin et al. | 123/598 |
| 3,739,759 | 6/1973 | Sleder | 123/598 |
| 3,870,028 | 3/1975 | Ishida | 123/598 |
| 4,069,801 | 1/1978 | Stevens | 123/598 |
| 4,448,181 | 5/1984 | Ishikawa | 123/598 |
| 4,679,540 | 7/1987 | Abe et al. | 123/632 |

*Primary Examiner*—Andrew M. Dolinar
*Attorney, Agent, or Firm*—Birch, Stewart, Kolasch & Birch

[57] ABSTRACT

An ignition apparatus of a capacitor discharge ignition type comprises: an ignition timing signal generator to generate an ignition timing signal synchronized with the rotation of the engine; a capacitor; a blocking oscillator; a rectifier for rectifying the output voltage of the blocking oscillator and applying the rectified voltage to the capacitor thereby charging the capacitor; a switching device which is turned on in response to the ignition timing signal and discharges the stored charges of the capacitor, thereby generating a pulse voltage across the terminals of the primary winding of an ignition coil; and an ignition plug to generate a spark discharge by a high voltage generated in the secondary winding of the ignition coil. The blocking oscillator oscillates concurrently with the engine rotation. When the ignition timing signal is generated, the oscillation of the blocking oscillator is stopped in accordance with a phase of the output voltage of the AC generator. With this apparatus, a vain charging of the capacitor and a vain spark discharge can be prevented when the engine's rotation stops. The generation of a counter torque on the engine can be certainly prevented.

1 Claim, 4 Drawing Sheets

IGNITION APPARATUS FOR PREVENTING UNNECESSARY CHARGING IN AN INTERNAL COMBUSTION ENGINE

FIELD OF THE INVENTION

The present invention relates to an ignition apparatus of an internal combustion engine and, more particularly, to an ignition apparatus of the capacitor discharge ignition (CDI) type.

DESCRIPTION OF THE RELATED BACKGROUND ART

FIG. 1 shows an example of a conventional ignition apparatus of the CDI type. This apparatus has a blocking oscillator 12. The blocking oscillator 12 comprises: a transformer 13 having four windings 13*a* to 13*d;* a transistor 14; diodes 15 and 16; resistors 17 and 18; and capacitors 19 and 20. An output voltage of a battery 11 is supplied to the base of the transistor 14 through the diode 15 and resistor 17, and the transistor 14 is turned on. Since a collector current flows through the winding 13*a* of the transformer 13 due to the turning-on of the transistor 14, a voltage is induced in the winding 13*b* in accordance with the voltage which is applied to the winding 13*a*. Since this voltage is applied to the base of the transistor 14 through the resistor 18, the base voltage decreases and the transistor 14 is turned off. Since no current flows through the winding 13*a* by the turning-off of the transistor 14, the voltage across the terminals of the winding 13*a* rapidly increases for only a moment and is stepped up by the transformer 13, thereby inducing pulse voltages in the windings 13*b* to 13*d*. Although the transistor 14 is reversely biased by the negative voltage pulse generated in the winding 13*b*, the base voltage of the transistor 14 gradually increases, so that the transistor 14 is again turned on. By repeating the foregoing operations, a pulse voltage is generated every predetermined period.

The pulse voltages developed in the windings 13*c* and 13*d* of the transformer 13 are supplied to an ignition circuit 21. The ignition circuit 21 comprises: transistors 22 and 23; diodes 24 to 28; thyristors (SCRs) 29 and 30; resistors 31 to 36; and capacitors 37, 39 and 40. One end of the winding 13*c* is connected to one end of a primary winding 41*a* of an ignition coil 41 through the diode 24 in the forward direction and through capacitor 37. A secondary winding 41*b* of the ignition coil 41 is connected to an ignition plug 42. the SCRs 29 and 30 and the diode 27 are forwardly serially connected between a connecting line of the diode 24 and capacitor 37 and the ground. On the other hand, a pulser coil 43 serves as an output coil of a pulse generator for generating a, sinewave pulse signal as an ignition timing signal for only one period at a predetermined angle position of a crank shaft. An output signal of the pulser coil 43 is half-wave rectified by the diode 28 and supplied to the base of the transistor 23 through the resistor 32. The transistors 22 and 23 are turned on each time an angle of crank shaft has reached a predetermined angle. An output voltage of the winding 13*d* is supplied to the gate of the SCR 29 through a trigger input circuit consisting of the diode 26, transistor 22, resistors 33 and 34, and capacitor 39. The output voltage of the winding 13*d* is also supplied to the gate of the SCR 30 through a trigger input circuit consisting of the resistors 35 and 36 and capacitor 40. Therefore, both SCRs 29 and 30 are turned on and all of the charges stored in the capacitor 37 are discharged to the primary winding 41*a* of the ignition coil 41, so that a high voltage is generated in the secondary winding 41*b* of the ignition coil 41 by the discharge energy. A spark discharge is generated from the ignition plug 42.

A stop control circuit 38 to stop the oscillating operation of the blocking generator 12 comprises: resistors 44 to 47; a transistor 48; a diode 49; a Zener diode 50; and a capacitor 51. When the SCRs 29 and 30 are turned on, gate voltages are supplied to the base of the transistor 48 through the resistor 45, so that the transistor 48 is turned on. The transistor 14 of the blocking generator 12 is turned off by the turning-on of the transistor 48, so that the oscillating operation of the blocking generator 12 is stopped. This stop operation is performed to prevent an overload being applied to the transformer 13 when the SCRs 29 and 30 are turned on. On the other hand, even if the withstanding voltage in the forward direction of the SCR decreases and a striking voltage of arc enough to turn on the SCR is not applied to the gate when the voltage between the anode and cathode of the SCR increases, the SCR is turned on. This situation is called a $V_{BO}$ ignition. To prevent such a $V_{BO}$ ignition, the SCRs 29 and 30 are serially connected as shown in FIG. 1.

The voltage generated in the winding 13*c* of the transformer 13 is supplied to the Zener diode 50 through the diode 49. Therefore, when this voltage exceeds the Zener voltage of the Zener diode 50, a base current flows through the transistor 48 and the transistor 48 is turned on. Thus, the oscillating operation of the blocking generator 12 is stopped in a manner similar to the above. This stop operation is executed to prevent the terminal voltage across the capacitor 37 from rising too high due to the charging.

However, in such a conventional ignition apparatus, even when the engine stops rotating, a pulse voltage is generated by the blocking oscillator and the capacitor is charged. Therefore, if the switching devices of the SCRs and the like have deteriorated even when an ignition timing signal is not supplied, a vain spark discharge is performed from the ignition plug by an increase of charging voltage of the capacitor in excess of a predetermined value.

On the other hand, in the case of a two-cycle engine, there is a case where a counter torque is generated depending on the positions of the piston and crank shaft at the time of ignition. Therefore, it is necessary to certainly block the generation of the counter torque.

SUMMARY OF THE INVENTION

It is the first object of the present invention to provide an ignition apparatus of a capacitor discharge ignition type in which when the engine stops rotating, the charging of a capacitor is stopped, thereby preventing a vain spark discharge in the case where a switching device has deteriorated.

The second object of the invention is to provide an ignition apparatus of the capacitor discharge ignition type in which a generation of a counter torque of the engine can be certainly prevented.

According to an ignition apparatus of the invention, a blocking oscillator is oscillated concurrently with the rotation of the engine, thereby preventing a vain charging of a capacitor when the engine stops rotating.

On the other hand, an ignition apparatus according to the invention comprises: an AC generator to generate an AC voltage in accordance with the rotation of the engine; and stop control means for stopping the oscillating operation of a blocking oscillator in accordance with a phase of output voltage of the AC generator when an ignition timing signal is generated.

DETAILED DESCRIPTION OF THE PREFERRED EMBODIMENTS

An embodiment of the present invention will be described hereinbelow with reference to FIGS. 2 to 5.

Figure 1:
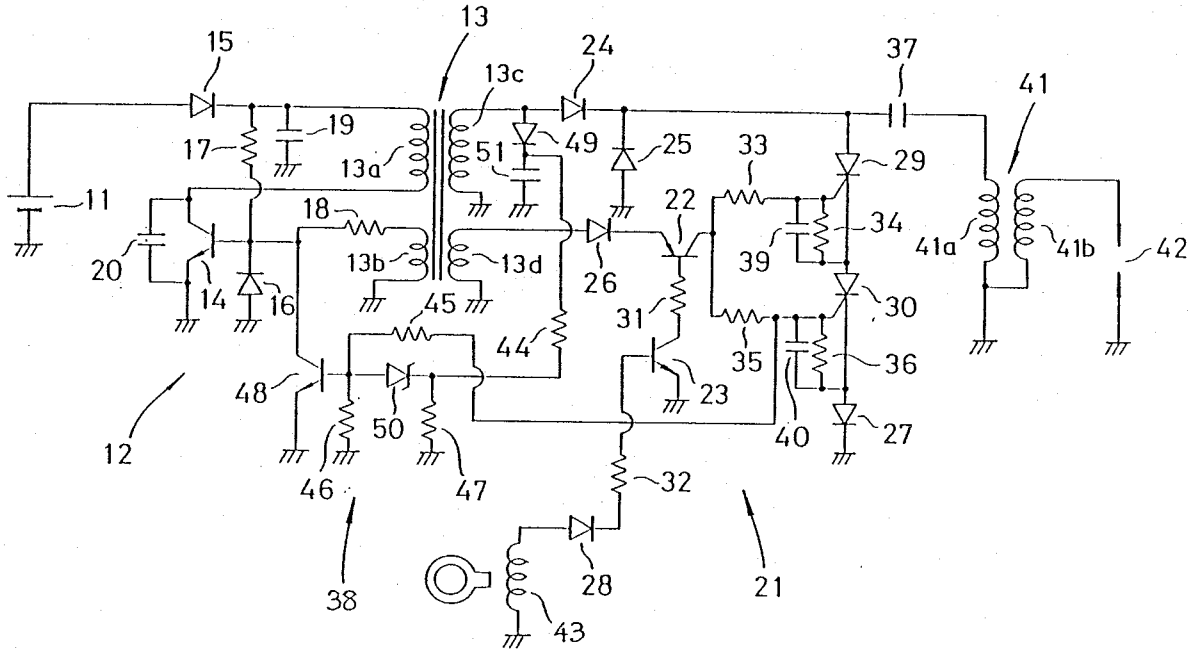
FIG 1 PRIOR ART
FIG. 1 is a circuit diagram showing a conventional ignition apparatus.
Figure 2:
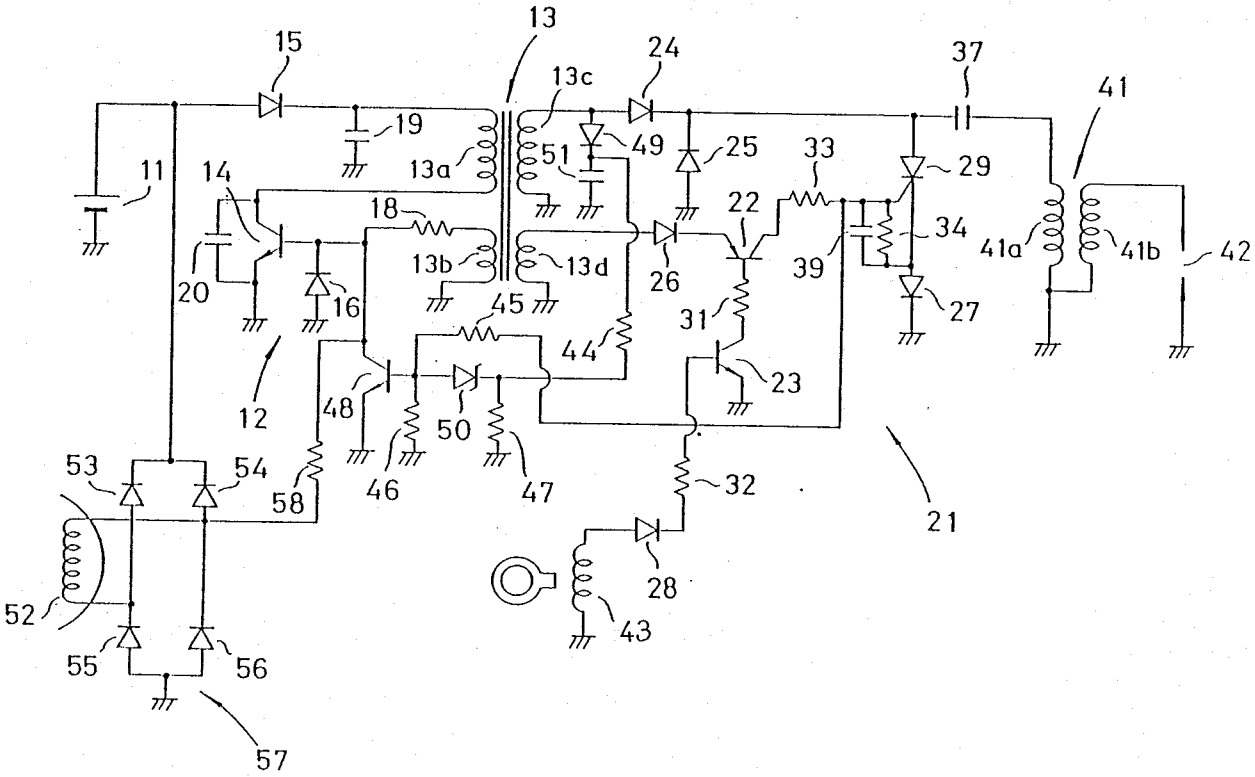
FIG. 2 is a circuit diagram showing an embodiment of the present invention.

FIG. 2 shows an ignition apparatus of the capacitor discharge ignition (hereinafter, simply referred to as a CDI) type as an embodiment of the invention. In this ignition apparatus, the same parts and components as those in the apparatus shown in FIG. 1 are designated by the same reference numerals. An exciting coil 52 functions as a power generation output coil of an AC generator to generate an AC voltage in accordance with the rotation of a crank shaft of an engine by a magnet coupled with the crank shaft. A bridge circuit 57 consisting of diodes 53 to 56 is connected to the exciting coil 52. A positive output terminal of the bridge circuit 57, namely, the cathodes of the diodes 53 and 54 are connected to a positive output line of the battery 11. A negative output terminal of the bridge circuit 57, i.e., the anodes of the diodes 55 and 56, is grounded. On the other hand, one end of the exciting coil 52 is connected through a resistor 58 to the base of the transistor 14 of the blocking generator 12. The construction of the blocking generator 12 is similar to that of the generator shown in FIG. 1, except that, the resistor 17 is omitted from generator 12 in FIG. 2. FIG. 2 is also similar to that of the apparatus shown in FIG. 1, except that only one SCR (SCR 29) is provided in the apparatus of FIG. 2.

In the ignition apparatus according to the invention, an AC voltage which is generated by the exciting coil 52 in response the rotation of the engine is full-wave rectified by the bridge circuit 57 and supplied to the battery 11, so that the battery 11 is charged. The AC voltage is half-wave rectified by the diode 16 and the output of the positive phase is supplied to the base of the transistor 14, so that the transistor 14 is turned on. A collector current flows through the winding 13*a* of the transformer 13 due to the turning-on of the transistor 14, thereby inducing a voltage in the winding 13*b*. Since this voltage reverse biases, namely, turns off the transistor 14, no current flows through the winding 13*a*. At this time, the voltage of the winding 13*a* rapidly increases for only a moment and is stepped up by the transformer 13, thereby inducing a pulse voltage in the winding 13*c*. When the next output of the positive phase of the AC voltage generated by the exciting coil 52 is supplied to the base of the transistor 14, the oscillation, i.e., the generation of the pulse voltage is continued, by repeating the foregoing operations again. Since the pulse voltage generated in the winding 13*c* of the transformer 13 is applied to the capacitor 37 through the diode 24, the capacitor 37 is charged. Thus, by turning on the SCR 29, a spark discharge is generated across the ignition plug 42.

On the other hand, when the rotation of the engine stops, the generation of the AC voltage from the exciting coil 52 is stopped, so that the transistor 14 is held in the off state. Therefore, the oscillating operation of the blocking generator 12 is stopped and no pulse voltage is generated from the winding 13*c* of the transformer 13, so that the capacitor 37 is not charged. Therefore, when the engine rotation is stopped even when the SCR 29 is in the on state, no spark discharge is generated across from the ignition plug 42.

Figure 3:
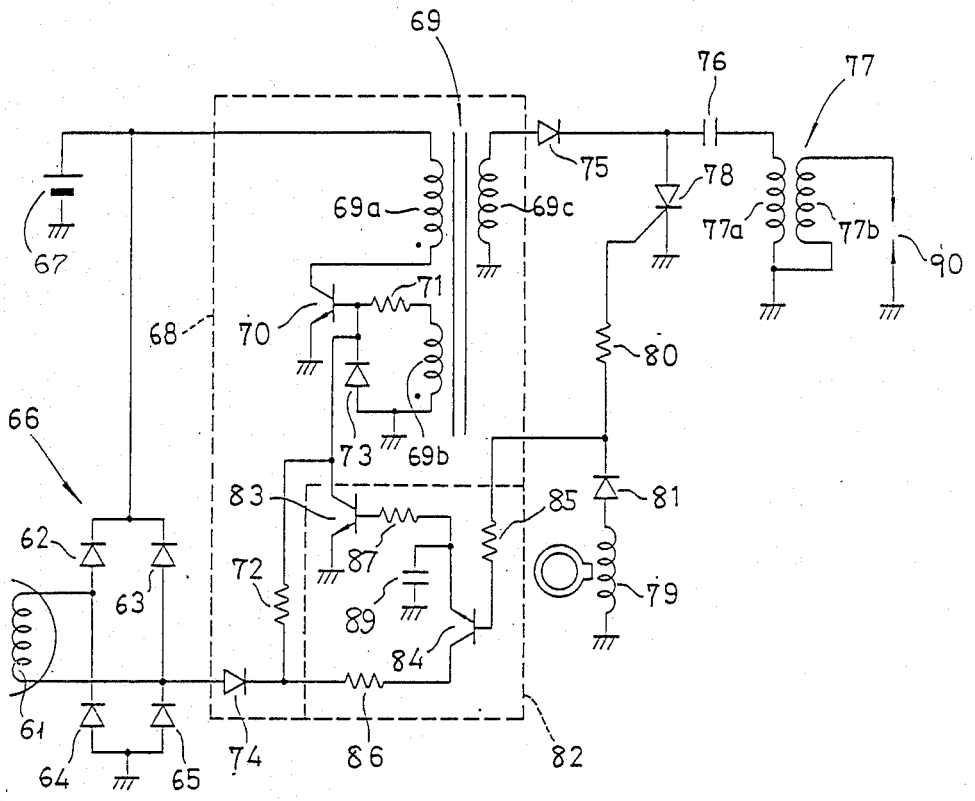
FIG. 3 is a circuit diagram showing another embodiment of the invention.

FIG. 3 shows another embodiment of the invention. In this ignition apparatus, an exciting coil 61 functions as a power generation output coil of an AC generator to generate an AC voltage in accordance with the rotation of a crank shaft (not shown) of the engine by a magnet coupled with the crank shaft. A bridge circuit 66 consisting of diodes 62 to 65 is connected to the exciting coil 61. A positive output terminal of the bridge circuit 66, i.e., the cathodes of the diodes 62 and 63 are connected to a battery 67. A negative output terminal of the bridge circuit 66, i.e., the anodes of the diodes 64 and 65, is grounded. On the other hand, a blocking oscillator 68 comprises: a transformer 69 having three windings 69*a*, 69*b*, and 69*c*; a transistor 70; resistors 71 and 72; and diodes 73 and 74. The base of the transistor 70 is connected to the anode of the diode 73 and is also connected through the resistor 71 to one end of the winding 69*b*. The emitter of the transistor 70, the cathode of the diode 73, and the other end of the winding 69*b* are grounded. The base of the transistor 70 is connected to one end of the exciting coil 61 through the resistor 72 and diode 74. The collector of the transistor 70 is connected to one end of the winding 69*a* The other end of the winding 69*a* is connected to a connecting line of the bridge circuit 66 and battery 67. The winding 69*c* serves as a coil to output an oscillation AC signal of the blocking oscillator 68. One end of the winding 69*c* is connected to one end of a primary winding 77*a* of an ignition coil 77 through a diode 75 in the forward direction and through a capacitor 76. A secondary winding 77*b* of the ignition coil 77 is connected to an ignition plug 90.

An SCR 78 is connected between the ground and a connecting line of the diode 75 and capacitor 76. The gate of the SCR 78 is connected to one end of a pulser coil 79 through a resistor 80 and a diode 81. The pulser coil 79 functions as an output coil of a pulser generator to generate a sinewave pulse signal of only one period as an ignition timing signal at a predetermined angle position of the crank shaft. An output signal of the pulser coil 79 is half-wave rectified by the diode 81.

A stop control circuit 82 stops the operation of the blocking oscillator 68 and comprises: transistors 83 and 84; resistors 85 to 87; and a capacitor 89. A cathode voltage of the diode 8 is supplied through the resistor 85 to the base of the transistor 84. A cathode voltage of the diode 74 is supplied through the resistor 86 to the collector of the transistor 84. The emitter of the transistor 84 is grounded through the capacitor 89 and is also connected through the resistor 87 to the base of the transistor 83. The emitter of the transistor 83 is grounded and the collector is connected to the base of the transistor 70.

In the ignition apparatus with the foregoing construction according to the invention, the AC voltage generated in the exciting coil 61 is full-wave rectified by the bridge circuit 66 and supplied to the battery 67, so that the battery 67 is charged. This AC voltage is also half-wave rectified by the diode 74 and the output of a positive phase is supplied through the resistor 72 to the base of the transistor 70, thereby turning on the transistor 70. A collector current flows through the winding 69*a* of the transformer 69 due to the turning on of the transistor 70, thereby inducing a voltage in the winding 69*b* Since this voltage reverse biases, i.e., turns off the transistor 70, no current flows through the winding 69*a*. At this time, the voltage of the winding 69*a* rapidly increases for only a moment and is stepped up by the transformer 69, thereby inducing a pulse voltage in the winding 69*c*. When the next output of a positive phase is supplied from the diode 74 through the resistor 72 to the base of the transistor 70, the oscillation, i.e., the generation of the pulse voltage is continued by repeating the foregoing operations again. The pulse voltage generated in the winding 69*c* of the transformer 69 is supplied through the diode 75 to the capacitor 76, so that the capacitor 76 is charged.

On the other hand, a pulse signal is generated from the pulser coil 79 at a predetermined angle position of the crank shaft. This pulse signal is half-wave rectified by the diode 81 and is supplied as an ignition timing signal to the gate of the SCR 78 through the resistor 80. Thus, the SCR 78 is turned on and all of the charges stored in the capacitor 76 are discharged to the primary winding 77*a* of the ignition coil 77. Therefore, a high voltage is generated in the secondary winding 77*b* of the ignition coil 77 by the discharge energy and a spark discharge is generated across the ignition plug 90.

Figure 4:
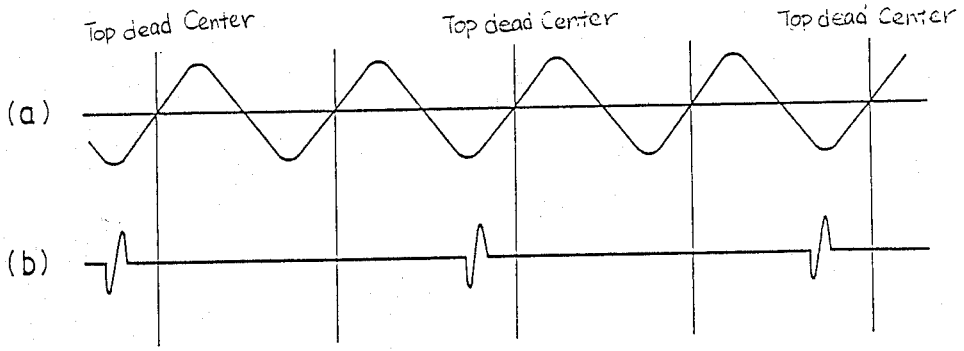
FIGS. 4 and 5 are waveform diagrams showing the operation of the circuit shown in FIG. 3.
Figure 5:
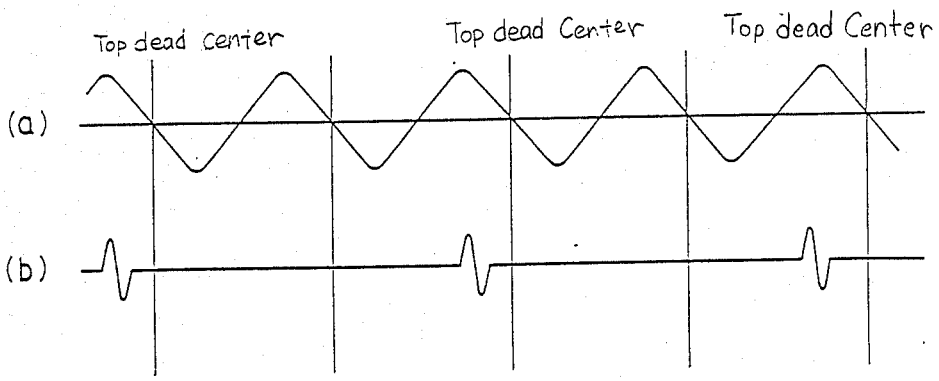

When the engine rotates in the forward direction, a power generation AC signal which is outputted from the exciting coil 61 of the AC generator has a waveform as shown in FIG. 4(*a*) on the anode side of the diode 74. A pulse signal which is outputted from the pulser coil 79 is generated at a timing corresponding to the negative voltage portion of the power generation AC signal as shown in FIG. 4(*b*). Thus, when the engine rotates in the reverse direction, a waveform of power generation AC signal which is outputted from the exciting coil 61 is shown in FIG. 5(*a*). Therefore, a pulse signal which is outputted from the pulser coil 79 is generated at a timing corresponding to the positive voltage portion of the power generation AC signal as shown in FIG. 5(*b*).

When the engine rotates in the forward direction, even if a pulse signal is supplied to the base of the transistor 84 through the diode 81 and resistor 85, a positive voltage is not outputted from the diode 74, so that the transistor 84 is not turned on. A base current in the transistor 83 does not flow. The transistor 83 is held in the off state. Accordingly, since the half-wave rectified signal is supplied from the diode 74 to the base of the transistor 70, the blocking oscillator 68 performs the oscillating operation in a manner as mentioned above. On the other hand, when the engine starts rotating in the reverse direction, while a positive voltage is supplied from the diode 74 to the collector of the transistor 84 through the resistor 86, a pulse signal is supplied to the base of the transistor 84 through the diode 81 and resistor 85. Thus, the transistor 84 is turned on and at the same time, a base current in the transistor 83 flows, thereby turning on the transistor 83. Thus, the base potential of the transistor 70 is equal to ground and the transistor 70 is turned off, so that the oscillating operation of the blocking oscillator 68 is stopped. Therefore, when the engine starts rotating in the reverse direction, no pulse signal is generated from the winding 69*c* of the transformer 69 and the capacitor 76 is not charged. Even if the SCR 78 is turned on, a spark discharge is not generated across the ignition plug 90.

In the foregoing embodiments of the invention, the AC generator used has had four poles. However, the invention is not limited to this case but can be also applied to an AC generator using other number of poles.

As described above, the ignition apparatus of an internal combustion engine according to the present invention, by oscillating the blocking oscillator concurrently with the rotation of the engine, no oscillation output is obtained when the engine stops rotating. Thus, a vain charging of the capacitor can be prevented.

On the other hand, in the invention, the reverse rotation of the engine is detected from the phase of the AC signal which is generated by the AC generator when an ignition timing signal is generated. When the reverse rotation is detected, the oscillating operation of the blocking generator is stopped. Therefore, an ignition is not performed and the generation of a counter torque on the engine can be prevented. Futhermore, it is also understood that the so-called pulser coil for producing a timing signal may be also used as the coil for producing the AC voltage.

What is claimed is:

1. An ignition apparatus of a capacitive discharge type for use in an internal combustion engine, comprising:

DC voltage generating means for generating a DC voltage;

an AC generator having a rotor rotating with the rotation of the engine so as to generate as AC current;

ignition timing signal generating means for generating an ignition timing signal synchronized with a rotation of the engine;

an ignition coil;

a capacitor;

a blocking oscillator including a transformer having, at least primary, secondary and ternary windings, a switching element connected with said primary winding thereby causing a primary current to flow in said primary winding when said switching element is turned on, said primary current having a magnitude which varies a magnitude of a secondary current flowing through said secondary winding;

energizing means, responsive to said AC current, for energizing said switching element;

a first rectifier for rectifying an output voltage from said ternary winding of said blocking oscillator and for supplying said rectified output voltage to said capacitor, thereby charging said capacitor;

a switching device, for discharging said capacitor in response to said ignition timing signal, thereby generating a pulse voltage across terminals of a primary winding of said ignition coil;

an ignition plug for generating a high voltage spark discharge across a spark gap; and stop control means, connected to said energizing means, for preventing the energization of said switching element by said energizing means when said ignition timing signal appears within a pre-selected half-wave period of said AC current;

said stop control means including, a half-wave rectifier for passing therethrough said pre-selected half-wave of said AC current, and switching means, responsive to said ignition timing signal and said pre-selected half-wave of said AC current, for preventing the energization of said switch element by said energizing means.

* * * * *